US005769253A

United States Patent [19]

Gross

[11] Patent Number: 5,769,253

[45] Date of Patent: Jun. 23, 1998

[54] MOLDED STRUCTURE INCORPORATING A TWO-POSITION PANEL AND/OR A BIASED HINGE HAVING AN OPERATING RANGE GREATER THAN 180 DEGREES

[75] Inventor: Richard A. Gross, Oconomowoc, Wis.

[73] Assignee: AptarGroup, Inc., Crystal Lake, Ill.

[21] Appl. No.: 627,644

[22] Filed: Apr. 4, 1996

[51] Int. Cl.[6] ..... B65D 47/08

[52] U.S. Cl. ..... 215/237; 220/339; 215/235; 222/556

[58] Field of Search ..... 220/334, 335, 220/337, 339, 329, 332, 333, 254, 259, 338; 215/235, 237; 222/153.14, 546, 556; 16/225

[56] References Cited

U.S. PATENT DOCUMENTS

| | | | |
|---|---|---|---|
| Re. 30,861 | 2/1982 | Krawagna . | |
| 4,236,653 | 12/1980 | Gach | 222/153.14 |
| 5,358,130 | 10/1994 | Mengeu et al. | 215/237 X |
| 5,368,176 | 11/1994 | Thanisch | 220/335 X |
| 5,400,912 | 3/1995 | Brown et al. | 215/237 X |
| 5,437,383 | 8/1995 | Stull | 220/335 X |
| 5,494,185 | 2/1996 | Dubach | 220/339 |
| 5,568,820 | 10/1996 | Dirksing | 220/339 X |

*Primary Examiner*—Allan N. Shoap
*Assistant Examiner*—Nathan Newhouse
*Attorney, Agent, or Firm*—Dressler, Rockey, Milnamow & Katz, Ltd.

[57] ABSTRACT

An improved molded structure is provided in the form of a container closure having a base and lid. A resilient elbow connects an extension arm to the lid. A spring link, which includes a first leg, a second leg, and a resilient second elbow connecting the legs, extends between the closure base and lid. A first film hinge connects the link first leg with the extension arm. A second film hinge connects the link second leg with the lid. A third film hinge connects the lid and base. A special panel can be connected by another hinge to the base or lid which includes a first engaging structure. The panel includes a second engaging structure for effecting a snap-fit engagement with the first engaging structure. The closure can be molded as a unitary structure with the panel in a first position, and subsequently the panel can be pivoted about the hinge to a second position with the first and second engaging structures in snap-fit engagement.

20 Claims, 9 Drawing Sheets

MOLDED STRUCTURE INCORPORATING A TWO-POSITION PANEL AND/OR A BIASED HINGE HAVING AN OPERATING RANGE GREATER THAN 180 DEGREES

TECHNICAL FIELD

This invention relates to improved molded structures. One aspect of the invention relates to a two-position molded wall or panel in the base or lid of a container closure. Another aspect relates to a unitary, biased hinge which is particularly suitable for use between a lid and body of a container closure. The biased hinge is especially suitable for a squeeze-type container dispensing closure wherein the body and hinged lid are molded as a unitary structure and wherein the closure also includes a valve which opens to dispense a product from the container when the container is squeezed and which automatically closes when the squeezing pressure is released.

BACKGROUND OF THE INVENTION AND TECHNICAL PROBLEMS POSED BY THE PRIOR ART

A variety of packages, including dispensing packages or containers, have been developed for personal care products such as shampoo, lotions, etc., as well as for other materials. One type of closure for these kinds of containers typically has a flexible, self-sealing, slit-type dispensing valve mounted over the container opening. When the container is squeezed, the fluid contents of the container are discharged through the valve. The valve automatically closes to shut off fluid flow therethrough upon removal of the increased pressure.

Designs of closures using such valves are illustrated in the U.S. Pat. No. 5,271,531. Typically, the closure includes a base or housing mounted on the container neck to hold the valve over the container opening.

The closure base can be provided with a lid for covering the valve during shipping and when the container is otherwise not in use. See, for example, FIGS. 31–34 of U.S. Pat. No. 5,271,531. Such a lid can be designed to prevent leakage from the valve under certain conditions. The lid can also keep the valve clean and/or protect the valve from damage. However, the presence of the lid when open may be objectionable to some users in some applications. For example, the open lid may inhibit viewing of the dispensing area or may require greater shelf space.

It would be desirable, therefore, to provide an improved hinge which could be used for, among other things, connecting a lid to a dispensing closure base so that the lid could be maintained in a non-interfering, open position. It would be particularly desirable to provide such an improved hinge for a closure wherein the open lid could be self-maintained in a fully open position without requiring the use of a latch. It would also be advantageous to provide such an improved hinge that could be used with other types of closures or even other types of articles.

Also, it would be beneficial if the improved hinge could be employed in a dispensing closure with a design that would readily accommodate the assembly of the closure components during manufacture of the closure.

Additionally, it would be desirable if such an improved hinge could be provided with a design that would accommodate efficient, high quality, large volume manufacturing techniques with a reduced product reject rate.

Further, such an improved hinge should advantageously accommodate its use in various closures with a variety of conventional containers having a variety of conventional container finishes, such as conventional threaded or snap-fit attachment configurations.

One aspect of the present invention provides an improved hinge which can accommodate designs having the above-discussed benefits and features.

The production of closures, including closures incorporating biased hinges, can involve the use of molding techniques which are difficult to execute properly. Further, the closure production process may require the use of a mold assembly which is difficult to build and maintain. Thus, it would be desirable to provide an improved closure which could be more easily produced with mold assemblies that are less of a problem to build and maintain.

Further, the design of such an improved closure should facilitate or at least readily accommodate the incorporation of other closure features, such as a lid with a biased hinge.

The improved closure design should also preferably facilitate or at least readily accommodate the placement or assembly of the closure components in a condition for installation on a container.

One aspect of the present invention provides an improved molded closure which can accommodate designs having the above-discussed benefits and features.

SUMMARY OF THE INVENTION

According to the present invention, an improved biased hinge is provided for connecting two members. The hinge is particularly suitable for use in a closure to maintain the closure lid in a non-interfering, open position which facilitates improved viewing of the open closure dispensing area and which provides better directional control of the product being dispensed.

The hinge can be designed to maintain the closure lid in a position that minimizes the amount of shelf space required for an open container. The hinge enhances user convenience with respect to the opening and closing of the lid. The lid can be self-maintained by the hinge in an open position with minimal manipulation required by the user to initially move the lid to the fully open position. No latching device is required to hold the lid in the fully open position.

The hinge is a unitary structure having a range of motion through more than 180 degrees, and the hinge has at least one self-maintaining position. The hinge structure includes first and second articulating members connected for relative articulation. The first and second articulating members may be a closure base and a closure lid, respectively, or vice versa.

An extension arm extends from the first articulating member. Preferably, a resilient first elbow connects the extension arm to the first articulating member.

The hinge structure also includes a spring link. A first film hinge connects one end of the spring link to the first articulating member, and a second film hinge connects another end of the spring link to the second articulating member. Preferably, the spring link is in the form of a first leg, a second leg, and a resilient second elbow connecting the two legs. The first film hinge connects the first leg to the first extension arm for relative pivoting movement about a first axis. The second film hinge connects the second leg with the second articulating member for relative pivoting movement about a second axis.

A third film hinge connects the first and second articulating members for relative pivoting movement about a main axis. The main axis is coplanar with the first and second axis only when the articulating members are at an unstable position between the limits of the range of motion.

According to another aspect of the invention, a molded closure for a container opening is provided with a structure that facilitates or at least readily accommodates the incorporation of other features such as hinges, that more readily facilitates the molding of the closure, and that facilitates the assembly of the closure for installation on a container.

In particular the closure includes a base for mounting to the container around the opening. The base defines a passage through which the container contents can be discharged. A lid is movable on the base between a closed position occluding the passage and a open position in which the passage is open. A two-position panel is provided on either the base or lid with a hinge connecting the panel to the base or lid which includes a first engaging structure. The panel includes a second engaging structure for effecting a snap-fit engagement with the first engaging structure. The closure can be molded as a unitary structure with the panel in a first position. Then the panel can be subsequently pivoted about the hinge to a second position with the first and second engaging structures in snap-fit engagement.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

Figure 1:
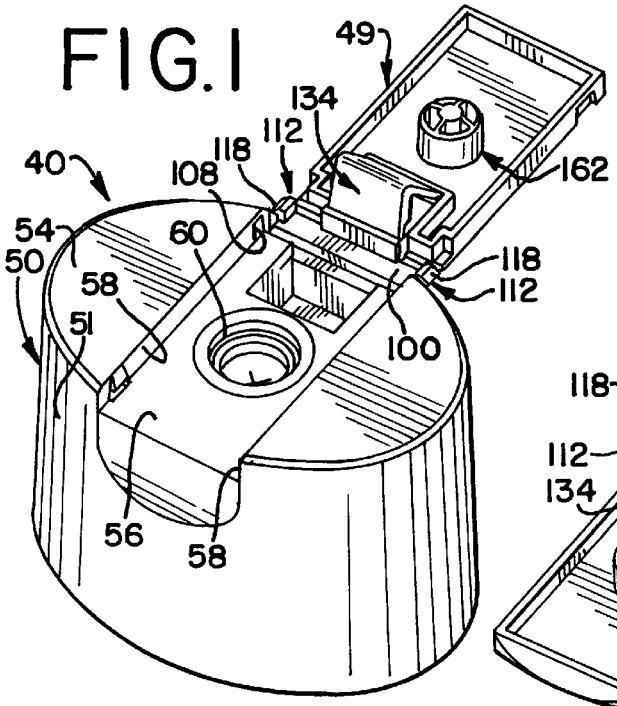
FIG. 1 is a front perspective view of a first embodiment of a closure incorporating one form of the biased hinge of the present invention and one form of the two-position panel of the present invention, and the closure is shown in FIG. 1 in an as-molded, unassembled condition with the panel in a first position.
Figure 2:
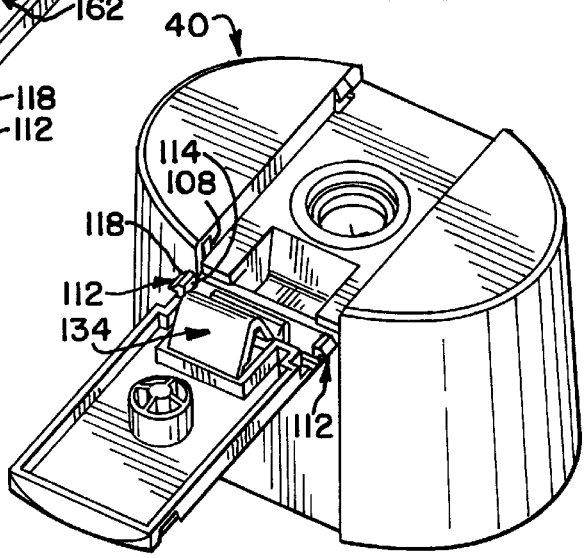
FIG. 2 is a rear perspective view of the closure shown in FIG. 1.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closures incorporating the hinge of this invention are described in various positions, and terms such as upper, lower, horizontal, etc., are used with reference to these positions. It will be understood, however, that the hinge and closures, or other articles which incorporate the hinge, may be manufactured and stored in orientations other than the ones described.

With reference to the figures, a first embodiment of a closure incorporating one form of the present invention is illustrated in FIGS. 1–21 and is represented generally in many of those figures by reference numeral 40. The closure 40 is adapted to be disposed on a container (not illustrated). The container may have a conventional mouth or opening formed by a neck or other suitable structure. The container neck typically has a round cross-sectional configuration, but the body of the container may have another cross-sectional configuration, such as an oval cross-sectional shape. The closure 40 may be fabricated from a thermoplastic material, or other materials, compatible with the container contents.

The container and closure 40 may be normally stored in the upright orientation wherein the closure 40 is at the top of the container and the closure is closed (FIGS. 9–12) or open (FIGS. 13–16). The container and closure 40 may also be stored in an inverted position while either open or closed. When stored in the inverted position, the closed or open closure 40 functions as a support base.

The container may be a squeezable container having a flexible wall or walls which can be grasped by the user and compressed to increase the internal pressure within the container so as to squeeze the product out of the container when the closure is opened (as explained in detail hereinafter). The container wall typically has sufficient, inherent resiliency so that when the squeezing forces are removed, the container wall returns to its normal, unstressed shape.

The closure 40 includes a hollow housing, base, or body 50 to which is mounted a lid 49 (FIG. 1). In the illustrated embodiment, the body 50 includes a peripheral sidewall 51. The wall 51 has a generally oval cross-sectional configuration which may generally match an oval configuration of the body of the container. The wall 51 may have other configurations if desired.

Figure 4:
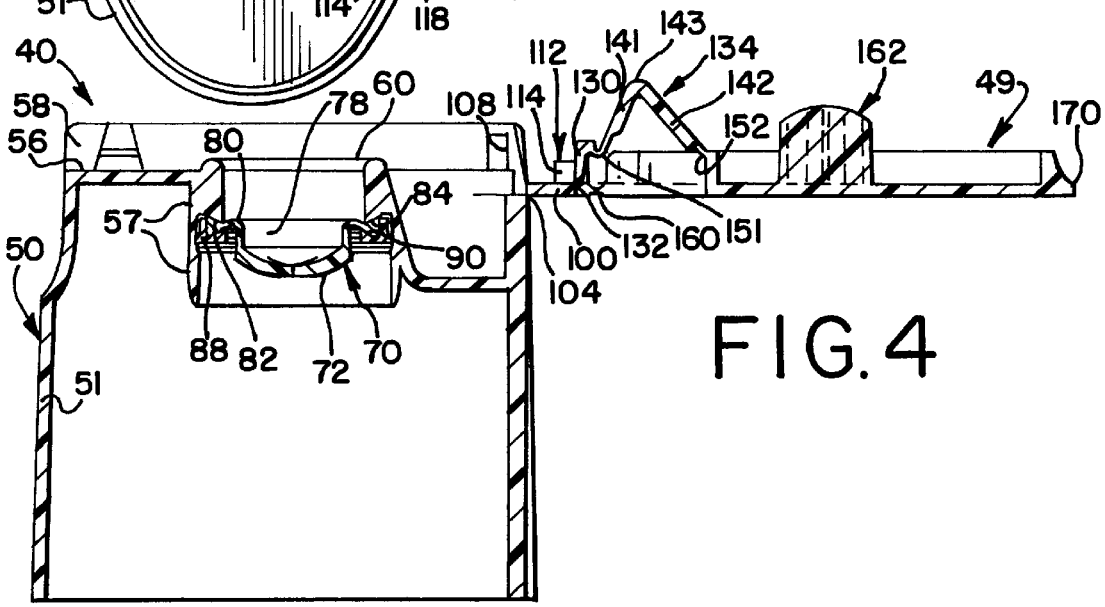
FIG. 4 is a cross-sectional view taken generally along the plane 4—4 in FIG. 3.

As illustrated in FIG. 1, the closure base 50 has an upper wall or surface 54 and a recessed, central deck 56. Vertical, spaced-apart, parallel walls 58 join opposing margins of the deck 56 to the upper wall or surface 54. As shown in FIGS. 1 and 4, the deck 56 defines a dispensing passage 60, and the dispensing passage 60 establishes communication between the exterior of the closure body deck 56 and the interior of the closure body 50.

In the preferred embodiment illustrated, the dispensing passage 60 has a circular configuration defined by a cylindrical collar 57 which is concentrically disposed with respect to the dispensing passage 60. As illustrated in FIG. 4, the collar 57 projects downwardly from the closure body deck 56. The bottom portion of the collar 57 is adapted to form a leak-tight seal with the connecting neck of the container. The collar 57 is generally cylindrical and may have a conventional snap-fit bead, thread, or other suitable means (not illustrated) for engaging suitable cooperating means on the container neck to secure the closure body 50 to the container. Alternatively, the inside of the closure base wall 51 could be provided with a snap-fit bead or thread (not illustrated) for engaging a mating structure on the container.

Mounted within the collar 57 is a valve 70 (FIG. 4). In the preferred form of the valve 70 illustrated, the valve 70 is of a known design employing a flexible, resilient material which can open to dispense product. The valve 70 is preferably fabricated from thermosetting elastomeric materials such as silicone, natural rubber, and the like. It is also contemplated that the valve 70 may be fabricated from thermoplastic elastomers based upon materials such as thermoplastic propylene, ethylene, urethane, and styrene, including their halogenated counterparts. A valve which is similar to, and functionally analogous to, valve 46 is disclosed in the U.S. Pat. No. 5,439,143. However, the valve 46 has a peripheral flange structure (described in detail hereinafter) which differs from the flange structure of the valve shown in the U.S. Pat. No. 5,439,143. The description of the valve disclosed in the U.S. Pat. No. 5,439,143 is incorporated herein by reference to the extent pertinent and to the extent not inconsistent herewith.

Figure 3:
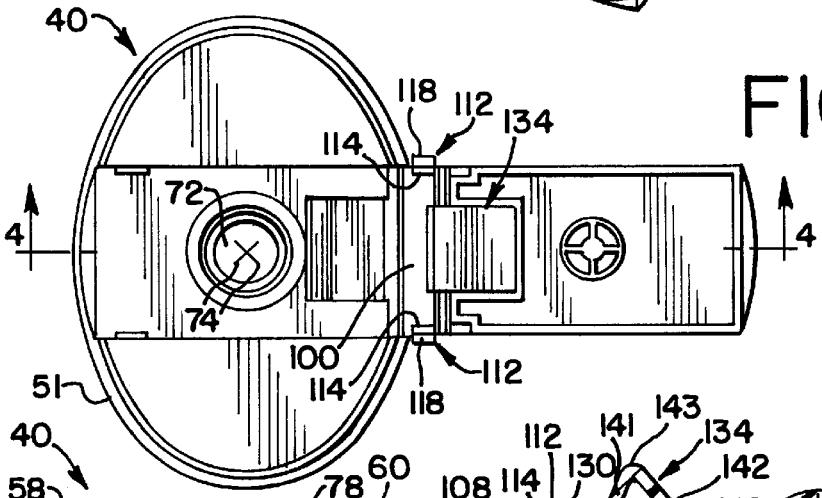
FIG. 3 is a top plan view of the closure illustrated in FIG. 1.
Figure 5:
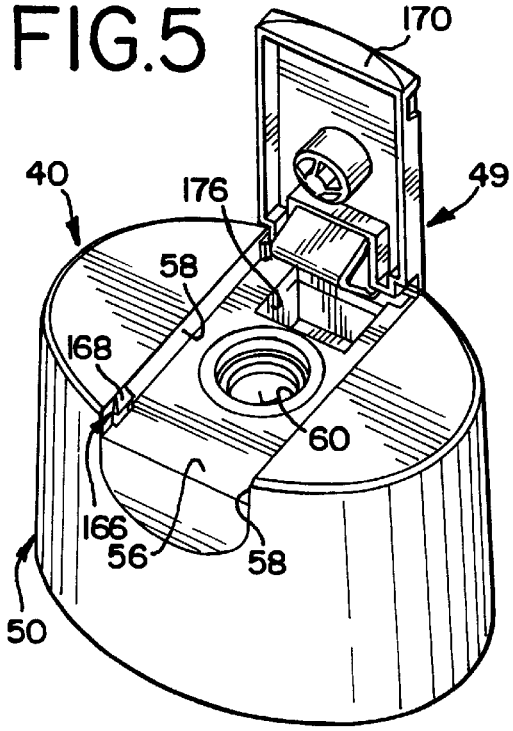
FIGS. 5–8 are views similar to FIGS. 1–4, respectively, but FIGS. 5–8 show the closure fully assembled with the panel snap-fit in a second position and with the lid in a stable, first, open, rest position, and the FIG. 8 view is taken generally along the plane 8—8 in FIG. 7.

As illustrated in FIGS. 3 and 5, the valve 70 includes a flexible, central wall 72 which has an outwardly concave configuration and which defines at least one, and preferably two, dispensing slits 74 extending through the central wall 72. A preferred form of the valve 70 has two, mutually perpendicular, intersecting slits 74 of equal length. The intersecting slits 74 define four, generally sector-shaped, flaps or petals in the concave, central wall 70. The flaps open outwardly from the intersection point of the slits 74 in response to increasing container pressure of sufficient magnitude in the well-known manner described in the U.S. Pat. No. 5,439,143.

The valve 70 includes a skirt 78 (FIGS. 4) which extends outwardly from the valve central wall 72. At the outer (upper) end of the skirt 78 there is a thin, annular flange 80 which extends peripherally from the skirt 78 in a downwardly angled orientation. The thin flange 80 terminates in an enlarged, much thicker, peripheral flange 82 which has a generally dovetail shaped transverse cross section.

To accommodate the seating of the valve 70 in the closure 40, the collar 57 defines an annular, downwardly facing, angled clamping surface 84 for engaging the top of the valve flange 82. The bottom of the valve flange 82 is engaged by an annular retention ring 88 which defines an upwardly angled, annular seating surface 90. The ring 88 is received in a snap-fit engagement in the collar 57.

The spacing between the upper clamping surface 84 and the ring seating surface 90 increases with increasing radial distance from the center of the valve 70. Such a configuration defines an annular cavity with a transverse cross section having a dovetail shape which generally conforms to the cross-sectional shape of the valve flange 82.

This clamping arrangement securely holds the valve 70 in the closure 40 without requiring special internal support structures or bearing members adjacent the interior surface of the valve cylindrical skirt 78. This permits the region adjacent the valve skirt 78 to be substantially open, free, and clear so as to accommodate movement of the valve skirt 78.

When the valve 70 is properly mounted within the closure 40 as illustrated in FIG. 4, the valve 70 is recessed relative to the top of the collar 57. However, when the lid 49 is open (FIGS. 13–16) and the container is squeezed to dispense the contents through the valve 70 (as described in detail in the U.S. Pat. No. 5,439,143), then the valve central wall 72 is forced outwardly from its recessed position toward the upper end of the dispensing passage 60.

In use, the container lid 49 is opened, and the container is typically inverted and squeezed to increase the pressure within the container above ambient. This forces the product within the container toward the valve 70 and forces the valve 70 from the recessed or retracted position (illustrated in FIG. 4) toward the outwardly extending position (not illustrated). The outward displacement of the concave, central wall 72 is accommodated by the relatively, thin, flexible, skirt 80. The skirt 80 moves from a closed, rest position to the pressurized position wherein the skirt is projecting outwardly closer to the top of the collar 57. However, the valve 70 does not open (i.e., the slits 74 do not open) until the valve central wall 72 has moved substantially all the way to a fully extended position near the upper end of the dispensing passage 60. Indeed, as the valve central wall 72 moves outwardly, the valve central wall 72 is subjected to radially inwardly directed compression forces which tend to further resist opening of the slits 74. Further, the valve central wall 72 generally retains its outwardly concave configuration as it moves outwardly and even after it reaches the fully extended position. However, when the internal pressure becomes sufficiently high, then the slits 74 of the valve 70 begin to open to dispense product. The product is then expelled or discharged through the open slits 74.

The lid 49 is adapted to be moved between a closed position (FIGS. 9–12), an intermediate position (FIGS. 5–8), and a full open position (FIGS. 13–16). When the closure 40 is initially molded, the lid 49 is molded as a unitary part of the closure 40 connected to the closure base 50 with a panel 100, and the panel 100 and lid 49 have a first, as-molded position extending generally parallel to the deck 56 as shown in FIGS. 1–4. The panel 100 is adapted to be moved after molding from the first position shown in FIGS. 1–4 to a second, operative, position shown in FIGS. 5–8. In the first position, the position of the panel 100 facilitates the molding of the closure because there is access for appropriate mold components to be moved directly against the top of the closure base 50, against the panel 100, and against the lid 49. The mold components can be reciprocated along the axis of the closure base discharge passage 60 to close the mold and then open the mold.

In the embodiment illustrated in FIGS. 1–4, the panel 100 may be characterized as an extension of the closure base 50, and the panel 100 is connected by a hinge 104 (FIGS. 4 and 17) to a remaining portion of the base 50 from which the hinge 104 and panel 100 extend. The hinge 104 is a reduced thickness of material and may be a conventional film hinge or living hinge.

As shown in FIGS. 1–4, the closure base 50 defines an aperture 108 in each wall 58 adjacent the deck 56. The apertures 108 function as engaging structures which engage mating engaging structures or tabs 112 on the panel 100. The tabs 112 each include a post 114 (FIGS. 3, 4, and 20) and a laterally projecting engaging arm 118. The arm 118 has an angled outer surface. When the panel 100 is pivoted upwardly from the as-molded first position (FIGS. 1–4) to the operative second position (FIGS. 5–8), the angled surface of the arm 118 engages the adjacent wall 58 on the closure base 50, and this causes the arm 118 to deflect inwardly until the panel 100 has been pivoted to the vertical orientation aligning the arm 118 with the aperture 108. The arm 118 then snaps outwardly into the aperture 108 in a snap-fit engagement (FIG. 20), and that maintains the panel 100 in the second position (FIGS. 20 and 5–8).

Figure 20:
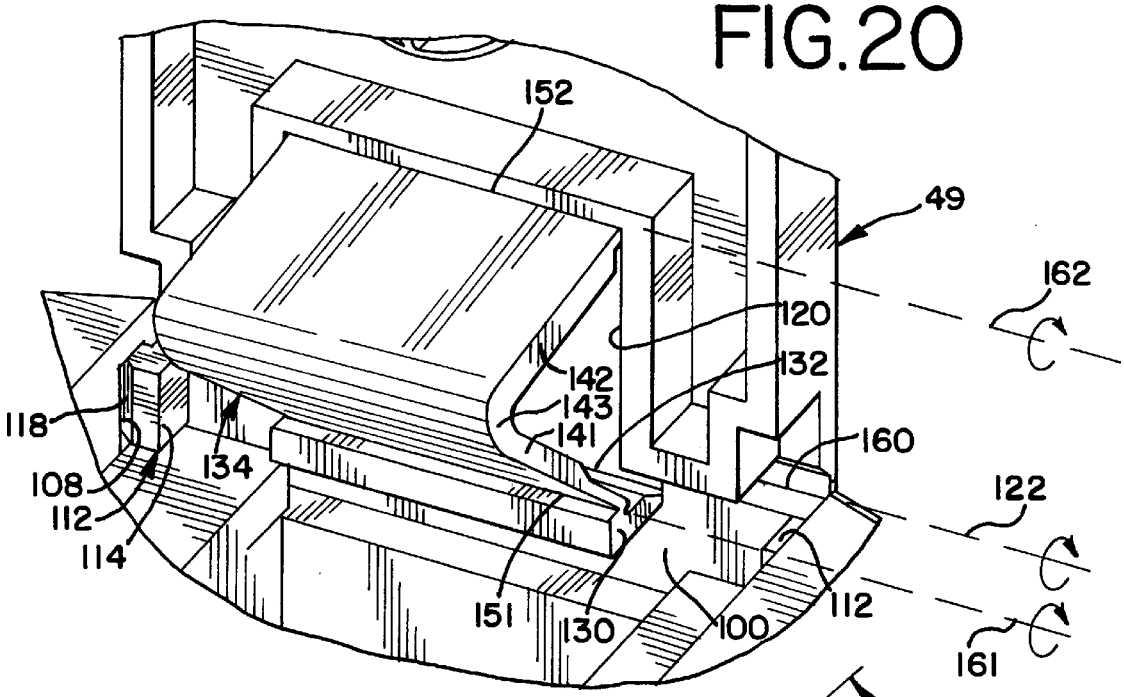
FIG. 20 is a view similar to FIG. 5, but FIG. 20 is a greatly enlarged, fragmentary, perspective view of the hinge region.

With reference to FIG. 20, a unitary hinge structure is provided for hingedly connecting the lid 49 to the closure base 50 as shown in FIG. 20. The hinge structure includes a first articulating member which, in the preferred embodiment illustrated in FIG. 20, is the closure base 50. The hinge structure also includes a second articulating member which, in the preferred embodiment illustrated in FIG. 20, is the lid 49. The lid 49 and base 50 are connected for relative articulation for pivoting movement about a main axis 122.

Figure 21:
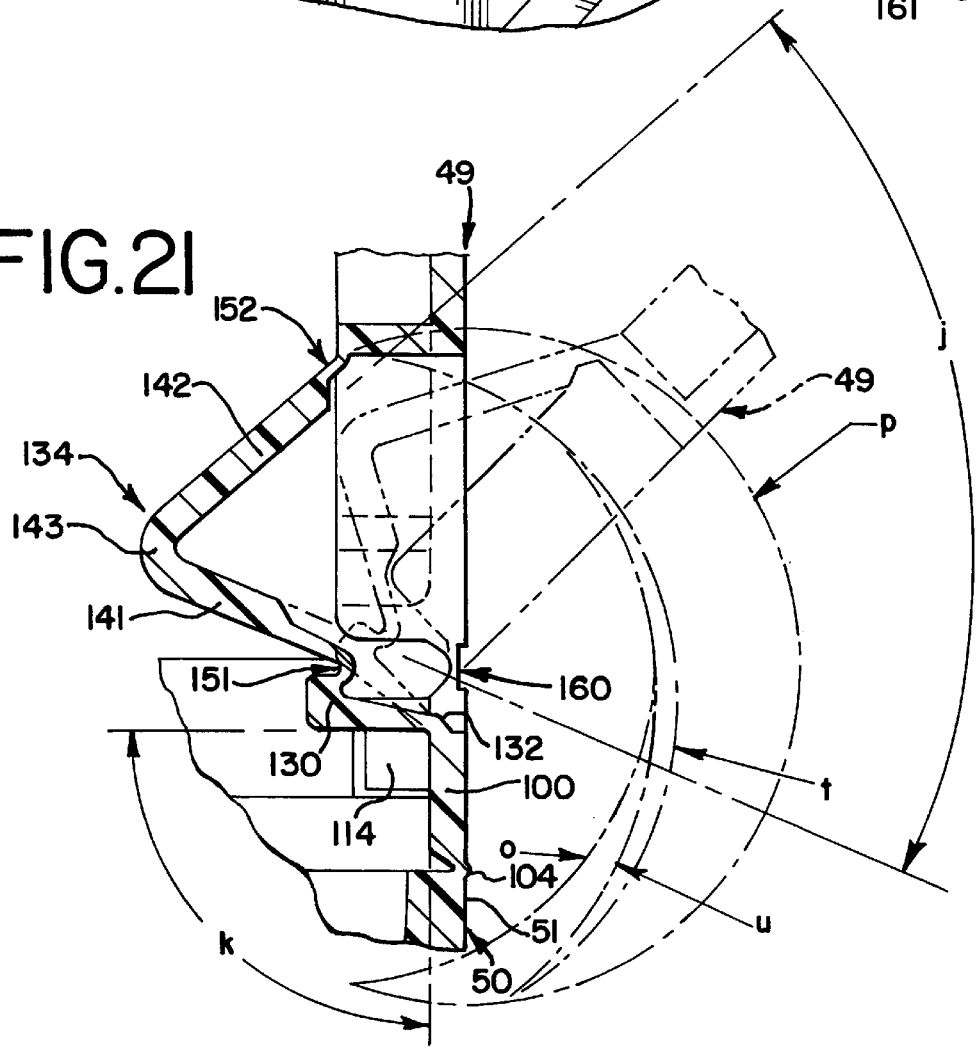
FIG. 21 is a view similar to FIG. 8, but FIG. 21 is a greatly enlarged, fragmentary, cross-sectional view of the hinge region.
Figure 22:
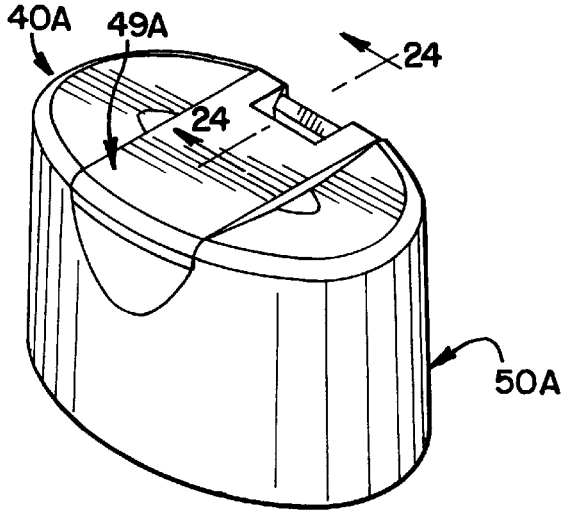
FIG. 22 is a view similar to FIG. 9, but FIG. 22 shows a second embodiment of a closure employing a hinge according to the teachings of the present invention.

An extension arm 130 extends from the panel 100 of the base 50. In the preferred embodiment, the extension arm 130 extends generally perpendicularly from the panel 100. The extension arm 130 is connected to the closure base panel 100 with a resilient first elbow 132 (FIGS. 20 and 21).

A spring link 134 connects the extension arm 130 to the lid 49. The spring link 134 includes a first leg 141, a second leg 142, and a resilient second elbow 143 connecting the legs 141 and 142. A first film hinge 151 connects the first leg 141 with the extension arm 130 for relative pivoting movement about a first axis 161 defined by the first film hinge 151. A second film hinge 152 connects the second leg 142 with the lid 49 for relative pivoting movement about a second axis 162 defined by the second film 152.

Figure 6:
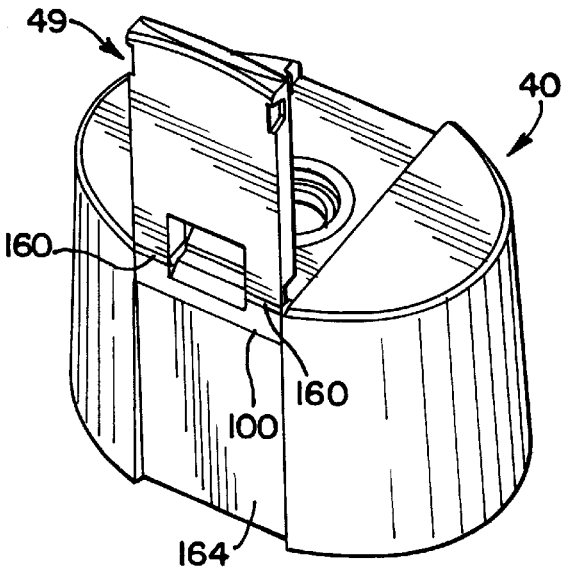
Figure 10:
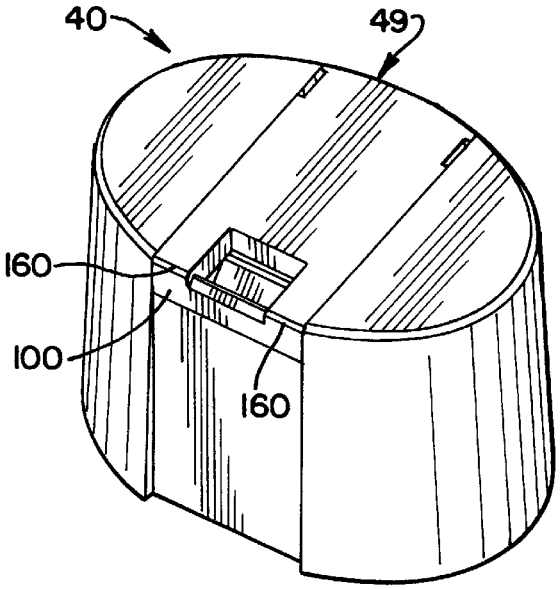
Figure 17:
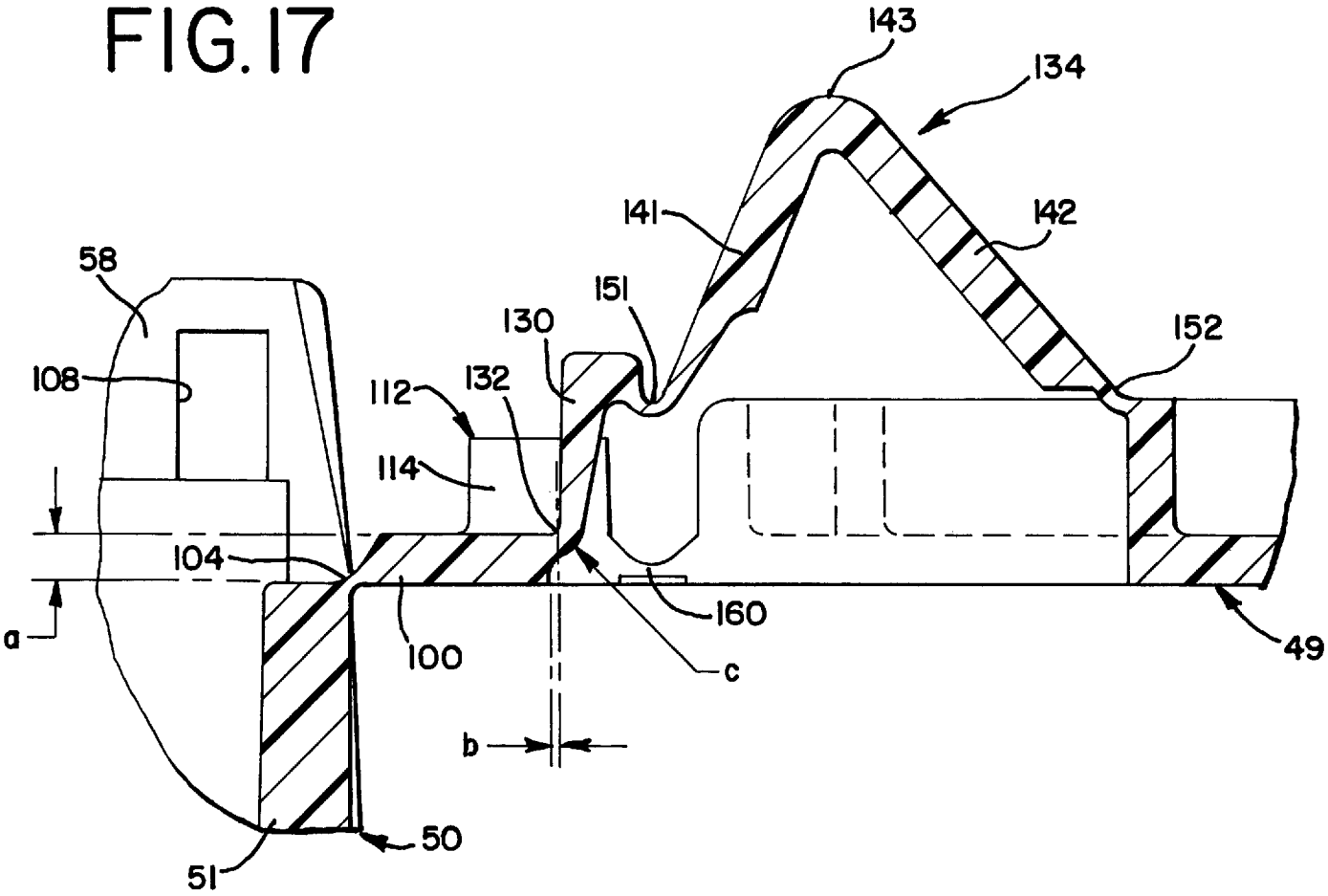
FIG. 17 is a greatly enlarged, fragmentary, cross-sectional view similar to FIG. 4 and shows the biased hinge region of a closure as molded with the panel in the first position prior to the closure components being assembled in an operating condition.
Figure 18:
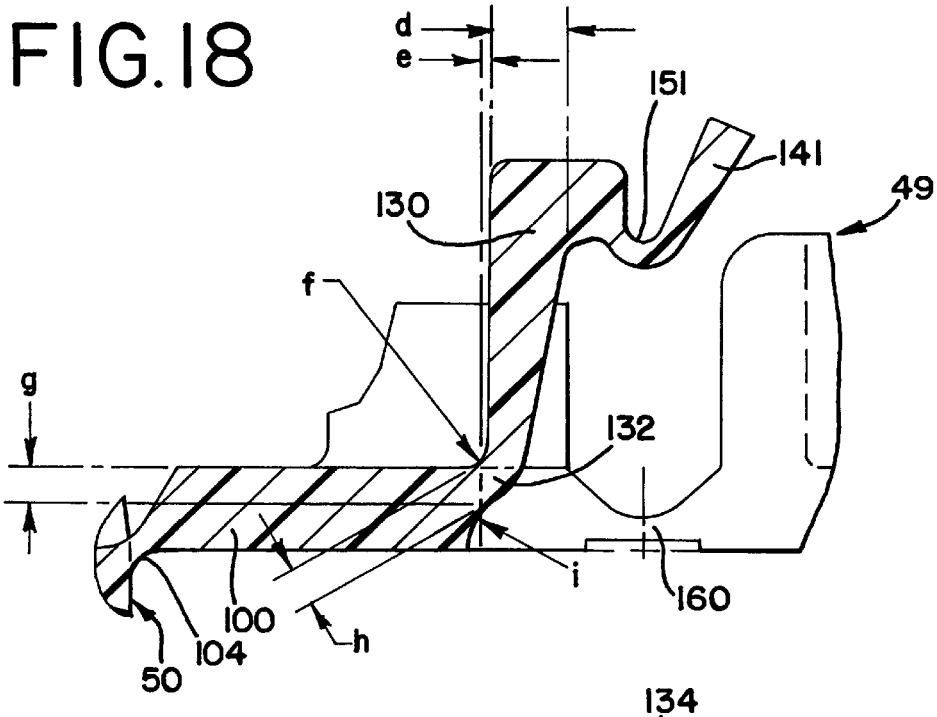
FIG. 18 is a view similar to FIG. 17, but FIG. 18 is an even more greatly enlarged view of a portion of the biased hinge.
Figure 19:
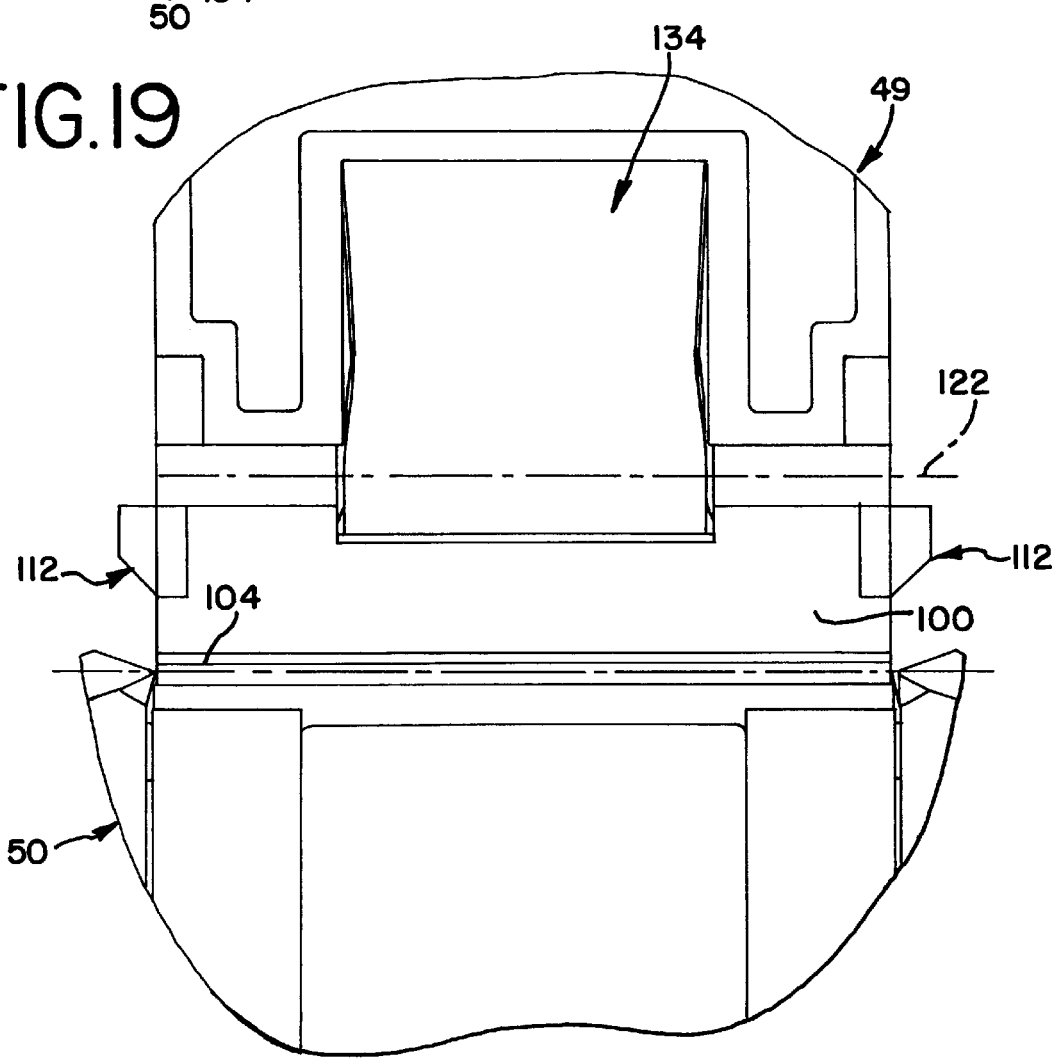
FIG. 19 is a view similar to FIG. 3, but FIG. 19 is a greatly enlarged, fragmentary, plan view of the biased hinge region.

As illustrated in FIGS. 6 and 10, the lid 49 is connected for pivoting movement to the body panel 100 by two, collinear, spaced-apart film hinges 160. FIGS. 17 and 18 show the film hinges 160 in greater detail. The film hinges 160 define the main axis 122 as illustrated in FIG. 20. The two film hinges 160 may be together regarded functionally as one film hinge, and this would be the third film hinge in the structure which also includes the first film hinge 151 and the second film hinge 152.

The above-described hinge structure can be readily molded in the open, first position illustrated in FIGS. 1–4 and 17–19. The molded hinge structure readily accommodates the subsequent movement of the lid 49 and panel 100 to the second, operative position shown in FIGS. 5–8, 20, and 21 wherein the panel 100 is maintained in a snap-fit engagement with the closure base walls 108. The hinge structure permits the lid 49 to be subsequently pivoted 90 degrees to the fully closed position on top of the closure base 50 as illustrated in FIGS. 9–12.

Figure 7:
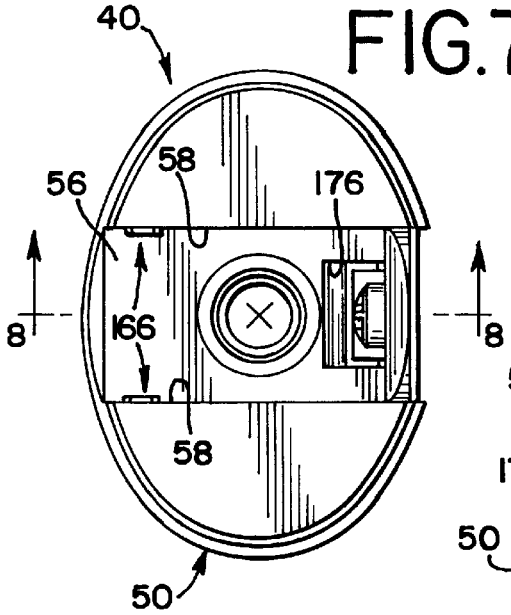
Figure 8:
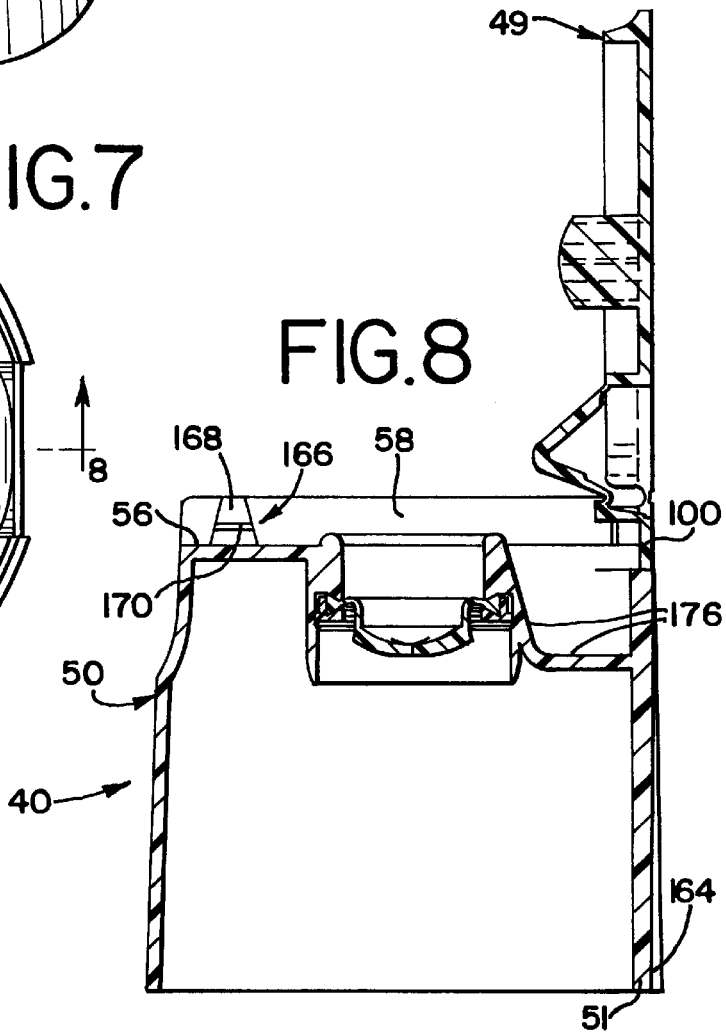
Figure 9:
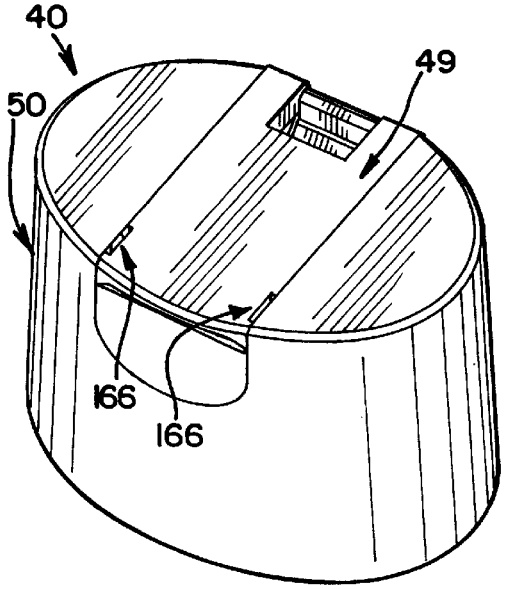
FIGS. 9–12 are views similar to FIGS. 5–8, respectively, but FIGS. 9–12 show the lid in the latched, closed position, and the FIG. 12 view is taken generally along the plane 12—12 in FIG. 11.
Figure 11:
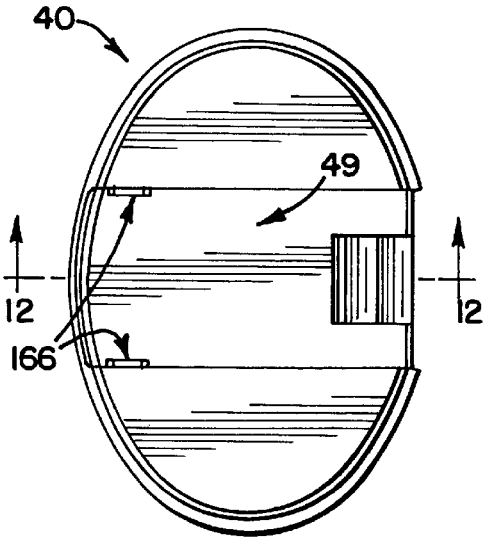

The lid 49 is latched to the base 50 in the closed position. The lid 49 is held in the closed position by snap-fit latch arrangement which includes a portion 166 of each vertical wall 58 projecting outwardly over the deck 56 as shown in FIGS. 5, 7, and 8. When the lid 49 is in the closed position as shown in FIGS. 9, 10, and 11, the projecting wall portion 166 on each vertical wall 58 engages an adjacent peripheral edge of the lid 49 to hold the lid 49 in place. As can be seen in FIGS. 5 and 8, each projecting portion 166 has a slanted upper surface 168 to guide the lid 49 into position over the deck 56 in the closed position. As the lid 49 is forced downwardly into the closed position, the slanted surface 168 of each projecting wall portion 166 is cammed or deflected outwardly a small amount. At the same time, or alternatively, the lid 49 may become slightly bowed (e.g., concave upwardly) so as to reduce its lateral dimension. In any event, sufficient, temporary deformation of the components permits the lid 49 to be moved between each projecting wall portion 166 and held therein by overlapping engagement.

Figure 12:
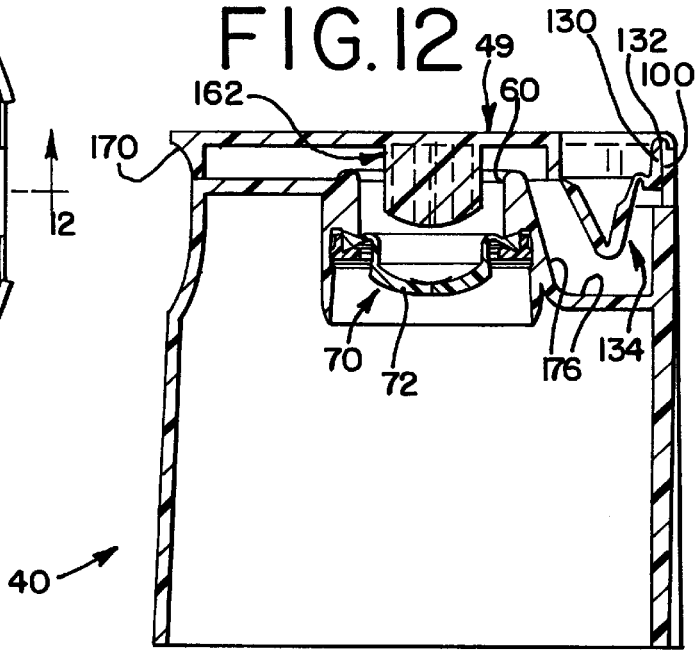

The closure base 50 accommodates the hinge structure when the lid 49 is closed. As can be seen in FIGS. 1 and 12, the closure base 50 defines a pocket 176 for receiving the link 134.

To assist in opening and closing the lid 49, the front of the lid defines an upwardly or outwardly projecting lift tab 170 (FIGS. 5 and 12). The lift tab 170 is adapted to be grasped between the index finger and thumb so that the front end of the lid 49 can be lifted upwardly as the lid 439 is initially swung or pivoted on its film hinge 160 about the main axis 122.

When the lid 49 is in the closed position (as illustrated in FIGS. 9–12), the valve 70 is prevented from opening when the container (whether upright or inverted) is squeezed (either purposefully or accidentally). To this end, the lid 49 includes a special inwardly projecting protuberance 162 (FIGS. 1 and 6). This protuberance 162 prevents the valve central wall 72 from moving or articulating sufficiently outwardly to open the dispensing slits 74. This is especially useful in preventing unwanted product leakage through the valve 70 which might otherwise occur in some circumstances. For example, there could be a tendency for the container contents to be forced through the valve 70 if the external pressure were suddenly reduced (e.g., during transport in an airplane) or if the container were subjected to an external impact force during shipping or handling. The protuberance 162 projects inwardly into the dispensing passage 60 sufficiently far to limit the outward movement of the valve central wall 72 during such a pressure differential condition. The outward movement of the central wall 72 is stopped by the protuberance 162 on the closed lid 49 before the valve slits 74 can begin to open.

Although the lid 49 must be open to permit dispensing of the container contents, the valve 70 is preferably designed so that when the container is inverted while the lid 49 is open, the weight of the container contents will not deflect the valve wall 72 outwardly under normal, static conditions, and the valve slits 74 will thus not open unless the container is also squeezed.

The previously described hinge structure accommodates the opening of the lid 49 to a fully open, self-maintained, stable position as illustrated in FIGS. 13–16 wherein the lid 49 has been pivoted about 270 degrees from its closed position and lies against the closure base sidewall 51. The closure base sidewall 51 is preferably provided with a recessed, planar wall 164 (FIGS. 6 and 16) for accommodating the lid 49 in a closely fitting relationship.

In the preferred embodiment illustrated, the hinge structure provides two self-maintained, stable positions which are about 180 degrees apart. One position is illustrated in FIGS. 5 and 20 wherein the lid 49 is maintained in a generally perpendicular orientation relative to the closure deck 56 so as to expose the dispensing passage 60. The second stable position of the hinge structure maintains the lid 49 in the fully opened orientation as illustrated in FIGS. 13–16.

When the lid 49 is moved away from either of the two stable positions (from the position shown in FIGS. 5–8 and 20 to the position shown in FIGS. 13–16 or vice versa), portions of the hinge structure deform elastically. At some intermediate position of the lid 49 between the two positions illustrated in FIGS. 5–8 and 13–16, the hinge structure deforms through a dead center position at which the hinge structure is maximally deformed. On either side of the dead center position, deformation of the hinge structure is at least partly reduced, and the hinge structure is urged to the stable position at the end of its travel range on that side of the dead center position. This provides a snap action as the lid is moved from the position shown in FIGS. 5–8 to the position shown in FIGS. 13–16 or vice versa.

The hinge structure is especially advantageous when employed in the closure 40 because once the lid 49 is moved to the full open position illustrated in FIGS. 13–16, the hinge structure maintains the lid 49 in that orientation. No auxiliary latch mechanism is required. The user of the closure does not need to hold the lid 49 in the full open position. The user of the closure may orient the closure (along with the container to which the container is mounted) in any desired position, and the lid 49 will remain held against the closure base wall 164 by the hinge structure.

In the preferred embodiment illustrated in FIGS. 17–20, the operation of the hinge structure is enhanced by appropriate design of the interconnected, relatively movable portions. Specifically, the first elbow 132 which connects the extension arm 130 with the panel 100 preferably has a thickness which is less than the thickness of the extension arm 130. Typically, the panel 100 also is thicker than the first elbow 132.

With reference to FIG. 17, a presently contemplated preferred embodiment molded from polypropylene has a panel 100 with a thickness (dimension a in FIG. 17) of about 0.045 inch, and the first elbow 132 has an outer radius (dimension c in FIG. 17) of about 0.03 inch. The first elbow inner radius (dimension f in FIG. 18) is about 0.01 inch.

The offset distance between the upper surface of the panel 100 and the lower surface of the panel 100 (dimension b in FIG. 17) is about 0.006 inch.

The thickness of the first elbow (dimension h in FIG. 18) is about 0.02 inch. The radius indicated by dimension i in FIG. 18 is about 0.035 inch. The dimension g in FIG. 18 is about 0.02 inch.

With reference to FIG. 18, the thickness of the extension arm 130 at the elevation of the first film hinge 151 (dimension d in FIG. 18) is about 0.04 inch. The offset dimension from the inner surface of the extension arm 130 to the upper surface of the panel 100 (dimension e in FIG. 18) is about 0.005 inch.

In the as molded condition, the angle defined by the spring link first leg 141 and second leg 142 (angle j in FIG. 21) is about 65 degrees. In some applications, this angle may be greater (e.g., about 90 degrees). The angle k in FIG. 21 is about 90 degrees.

The thickness of the first film hinge 151 connecting the first elbow 130 with the link first leg 141 is about 0.012 inch. The thickness of the second film hinge connecting the second leg 142 with the lid 49 is about 0.012 inch.

In the preferred embodiment of the hinge structure illustrated in FIGS. 17–21, the connecting link 134 is not as rigid as the other portions of the hinge structure to which the link 134 is connected by the film hinges 151 and 152. The extension arm 130 may have the same thickness as the first leg 141 of the connecting link 134, but the extension arm 130 is more rigid than the leg 141 owing to the position of the arm 130 between the second film hinge 151 and the first elbow 132.

FIG. 21 illustrates the pivoting of the structure from the position in which the lid 49 has a vertical orientation toward the position in which the lid is located downwardly alongside the closure base sidewall 51. When the lid 49 is pivoted downwardly in the clockwise direction as viewed in FIG. 21, the first and second film hinges 151 and 152, respectively, move about the stationary main film hinge 160 which defines the main axis 122 of the closure lid rotation.

Initially, as shown in phantom by dashed lines in FIG. 21, the angle j defined by the link legs 141 and 142 increases as the legs 141 and 142 are stretched and subjected to tension forces. The first elbow 132 is also subjected to tensional stress, and the extension arm 130 will be pulled upwardly (clockwise as viewed in FIG. 21). At some intermediate position (beyond the phantom position of the lid 49 shown in FIG. 21) the three axes defined by the first film hinge 151, second film hinge 152, and main axis hinge 160 lie in a common plane defining the dead center condition wherein the hinge structure components are under maximum stress. This is the unstable equilibrium position from which the lid 49 may be released to snap either way to one of two stable positions (either FIG. 8 or FIG. 16).

The trajectory of the axis of the second film hinge 152 is shown in FIG. 21 and is designated with the reference letter p. For illustrative purposes, reference letter t designates the theoretical trajectory of the axis of the second film hinge 152 if the rotation of the structure was centered on the axis of the first film hinge 151 assuming that the extension arm 130 did not bend about its elbow 132.

Also for illustration purposes, the reference letter u designates the theoretical trajectory of the axis of the second film hinge 152 assuming that the hinge structure was pivoted about the axis of the first film hinge 151 while the first film hinge 151 is allowed to move at the end of the extension arm 130 owing to the bending of the elbow 132.

Also for illustration purposes, the reference letter o identifies the theoretical trajectory of the axis of the second film hinge 152 if the hinge structure could be pivoted about the axis of the first film hinge 151 when that first film hinge axis is located at its dead center location.

In order to close the lid 49 from the stable, perpendicular orientation on the closure base deck illustrated in FIGS. 5–8, force must be applied to the lid 49 (in the counterclockwise direction as viewed in FIGS. 8 and 21) to overcome the inherent resiliency of the hinge structure. As the lid 49 begins to pivot toward the closure base deck 56 (in the counterclockwise direction as viewed in FIGS. 8 and 21), the extension arm 130 pivots about the elbow 132 toward the panel 100, and this reduces the included angle k (FIG. 21). This places the elbow 132 in a state of compression. Owing to the offset location of the elbow 132 in relation to the main axis of the main hinge 160, relative rotation between the lid 49 and the closure base 50 can continue.

As the rotation of the hinge structure continues in the counterclockwise direction as viewed in FIG. 21, the angle j defined by the link legs 141 and 142 decreases, and the second film hinge 152 advances closer to the first film hinge 151. This places the resilient connecting link 134 in a state of compression.

When the lid 49 is finally seated on the closure deck 56 (FIG. 12), the lid 49 has undergone about 90 degrees rotation from the perpendicular orientation shown in FIGS. 5–8. The hinge structure is under significant compression, and this tends to bias the lid 49 upwardly away from the closure deck 56. Therefore, the lid 49 must be held or latched in the closed position, such as by means of the latched wall portions 166 described above.

When the lid is in the fully closed position as shown in FIG. 12, the extension arm 130 has been pivoted on the elbow 132 substantially 90 degrees so that the extension arm 130 is substantially vertically oriented against the inside surface of the closure base panel 100.

When the latches are released, the lid 49 will, owing to the compression in the hinge structure, move or snap upwardly to the generally vertical or perpendicular orientation illustrated in FIGS. 5–8. In order to provide further clearance around the dispensing passage 60, the lid 49 can be pushed further in the clockwise direction as viewed in FIGS. 8 and 21—at least until the dead center position is just passed so that the lid 49 will thereafter be automatically biased by the hinge structure to the fully opened position illustrated in FIGS. 13–16.

Figure 13:
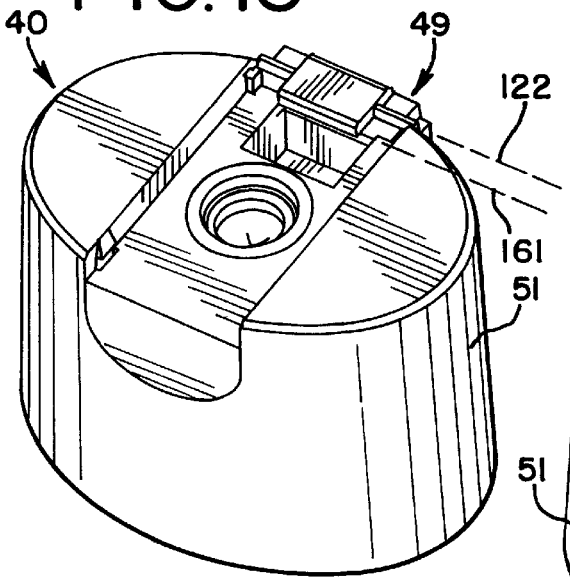
FIGS. 13–16 are views similar to FIGS. 9–12, respectively, but FIGS. 13–16 show the lid biased to a second, stable orientation wherein the lid is in a fully open, non-interfering position, and the FIG. 16 view is taken generally along the plane 16—16 in FIG. 15.
Figure 14:
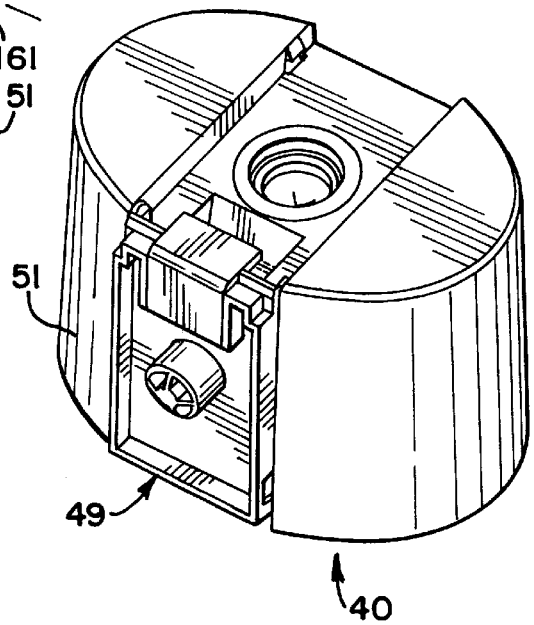
Figure 15:
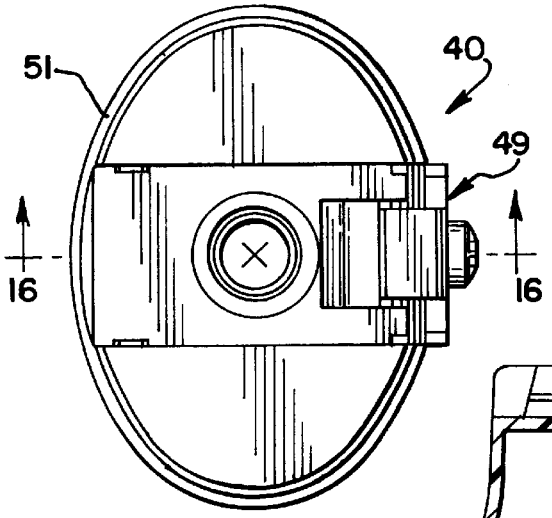
Figure 16:
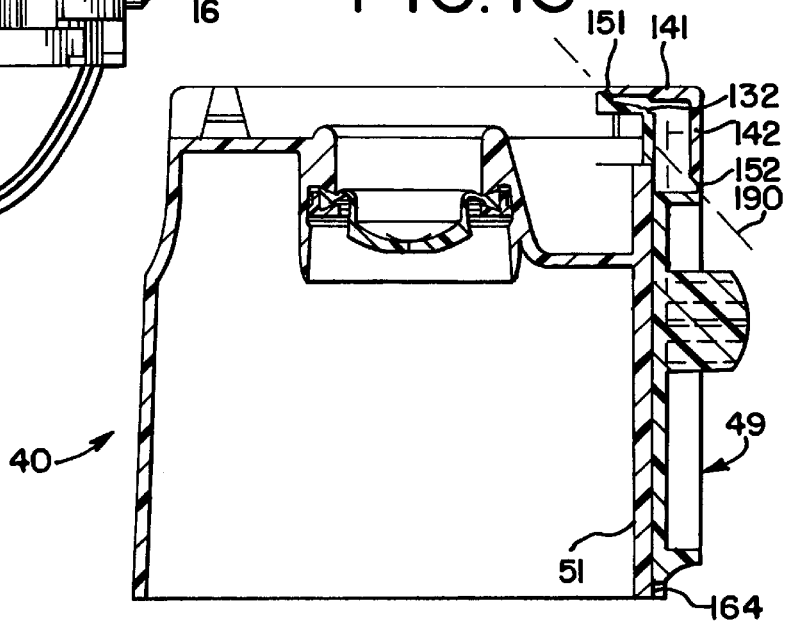

It is apparent with reference to FIGS. 13 and 20 that the main hinge axis 122 defined by the third film hinge 160 is offset a small amount upwardly from the first axis 161 defined by the first film hinge 151. Further, when the lid 49 is in the fully opened position (FIG. 16), a plane 190 is defined by the axes of the first film hinge 151 and second film hinge 152. The plane 190 lies to the left of both the first elbow 132 and the main film hinge 160 (not visible in FIG. 16). Further, the included angle defined between the first leg 141 and second leg 142 is slightly greater than the included angle j when the lid 49 is in the stable, perpendicular orientation (FIG. 21). Thus, in the fully opened position shown in FIG. 16, the legs 151 and 152 are under a tension stress, and this creates a biasing force tending to urge the lid 49 to the open position against the closure base sidewall 51.

A second embodiment of the closure of the present invention is illustrated in FIGS. 22–27 and is designated therein generally by the reference numeral 40A. The closure 40A includes a closure body 50A and a lid 49A. The lid 49A and closure body 50A each has a structure similar to that described above for the lid 49 and closure body 50, respectively, of the first embodiment illustrated in FIGS. 1–17. However, the closure 40A of the second embodiment illustrated in FIGS. 22–27 is initially molded in two separate pieces instead of as a unitary structure. One of the separate pieces includes the lid 49A as well as an extending panel 100A which functions as a fixed part of the closure base 50A after assembly with the closure base 50A. The second embodiment panel 100A is somewhat similar to the panel 100 of the first embodiment, but the panel 100A is not attached through a unitary hinge to the closure base. Thus, the hinge 104 of the first embodiment (FIG. 21) is omitted from the second embodiment.

Figure 27:
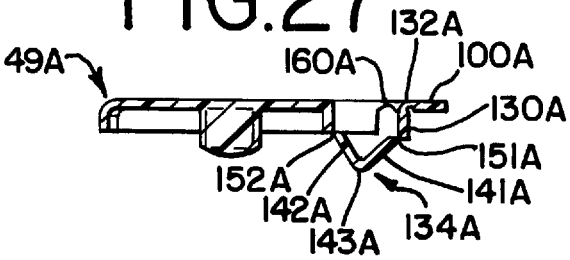
FIG. 27 is a cross-sectional view taken generally along the plane 27—27 in FIG. 26.
Figure 28:
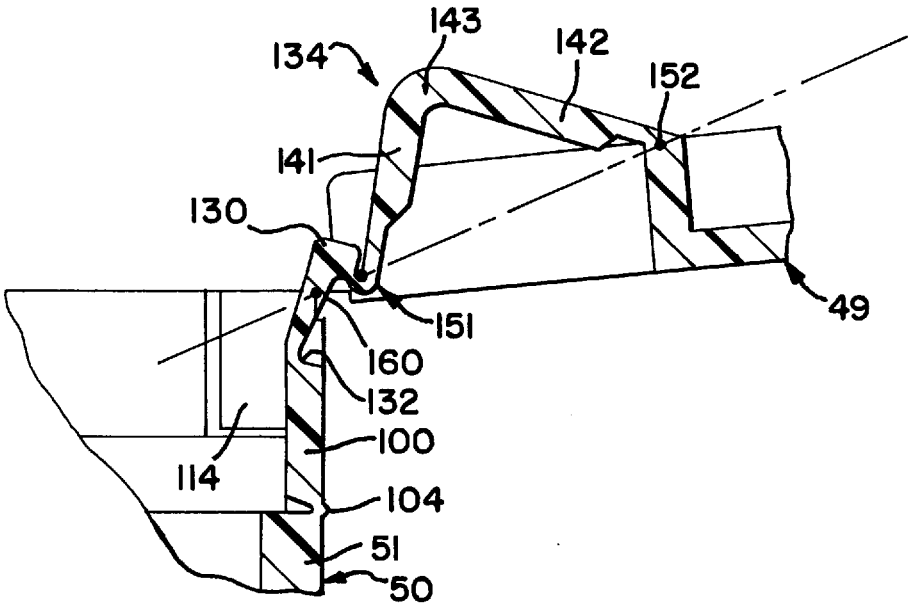
FIG. 28 is a fragmentary, enlarged, cross-sectional view of the hinge region similar to FIG. 21, but with the components rotated further in the clockwise direction.

As shown in FIG. 27, the panel 100A is molded as a unitary extension on the lid 49A. The lid 49A and panel 100A may be regarded as joined by a unitary connecting film hinge 160A which defines a main pivot axis of the closure after the combined lid and panel are mounted in the closure base 50A. The panel 100A may thus be defined as extending from its rearward edge to the film hinge 160A defining the main pivot axis of the lid. When properly assembled in the base 50A as described hereinafter, the panel 100A functions as a stationary upwardly extending wall portion of the closure base 50A.

Figure 23:
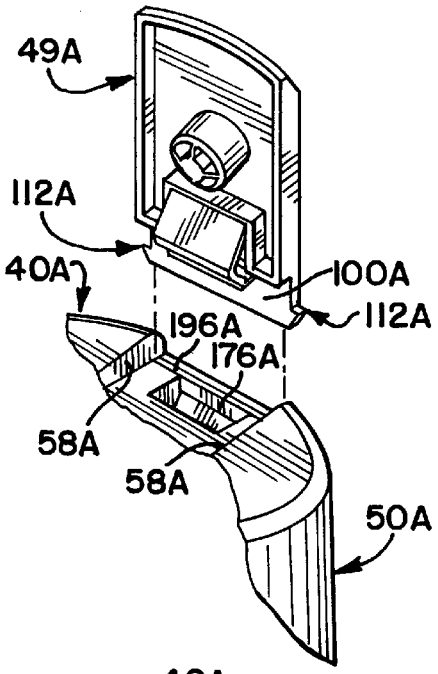
FIG. 23 is a fragmentary, exploded, perspective view of the closure showing the separately molded lid in position to be inserted into the closure base.

The panel 100A has two laterally projecting engaging tabs 112A. The panel 100A is adapted to be mounted to the closure base 50A which defines an upwardly open slot 196A for receiving a lower portion of the panel 100A. The panel tabs 112A lock under the slot lateral ends defined by the bottoms of the closure base deck walls 58A (FIG. 23).

An extension arm 130A is connected with an elbow 132A to the panel 100A. The elbow 132A accommodates bending of the extension arm 130A through an angle of about 90 degrees.

The distal end of the extension arm 130A is connected to a link 134A (FIG. 27) comprising a first leg 141A and a second leg 142A which are connected by a second elbow 143A. The first leg 141A is connected to the extension 130A with a first film hinge 151A, and the second leg 142A is connected to the lid 49A with a second film hinge 152A.

Figure 24:
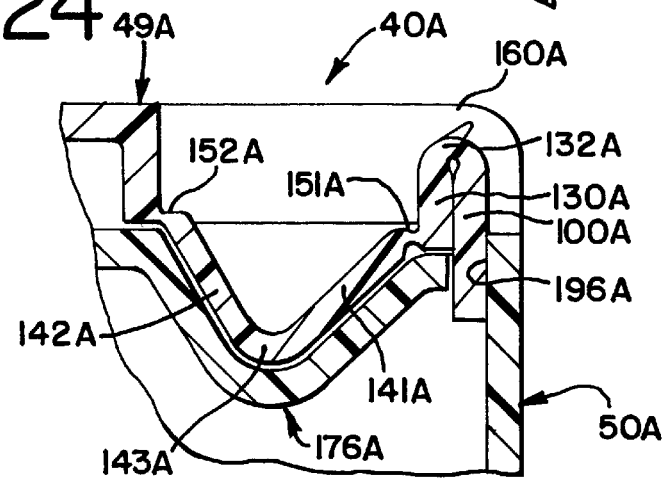
FIG. 24 is a greatly enlarged, fragmentary, cross-sectional view taken generally along the plane 24—24 in FIG. 22.
Figure 25:
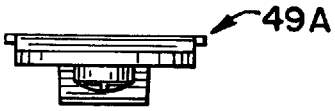
FIG. 25 is an end view of the closure lid which includes the hinge.
Figure 26:
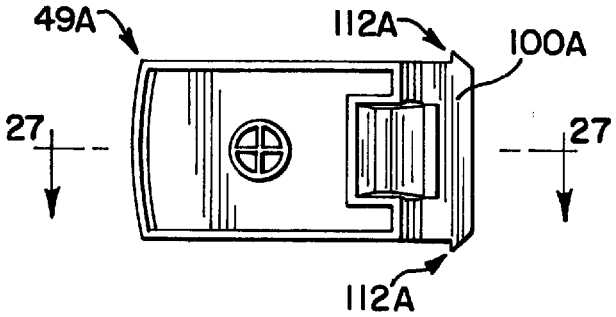
FIG. 26 is a bottom plan view of the closure lid.

The hinge structure for the second embodiment of the closure illustrated in FIGS. 22–27 functions in the same manner as the hinge structure described above with reference to FIGS. 1–21. Thus, when the lid 49A is in the closed position (FIGS. 22 and 24), the lid 49A must be latched. Suitable latching projections, similar to the first embodiment latching projections 166 (FIGS. 5, 8, and 9), may be employed. When the lid is in the closed position as illustrated in FIG. 24, the hinge structure spring link 134A is received in a pocket 176A. The extension arm 130A has pivoted about 90 degrees so that it is adjacent the panel 100A. The panel 100A, having been installed in the slot 196A of the closure base 50A, functions as a stationary part of the base 50A.

It will also be appreciated that the hinge structure of the present invention and panel structure of the present invention may be provided in a variety of closures having various dispensing structures. The hinge structure may also be provided in articles other than closures.

It will be readily observed from the foregoing detailed description of the invention and from the illustrations thereof that numerous other variations and modifications may be effected without departing from the true spirit and scope of the novel concepts or principles of this invention.

What is claimed is:

1. A unitary hinge structure having a range of motion through more than 180° to at least one self-maintained position, said hinge structure comprising:

first and second articulating members connected for relative articulation;

an extension arm extending from said first articulating member;

a resilient first elbow connecting said extension arm to said first articulating member;

a spring link comprising a first leg, a second leg, and a resilient second elbow connecting said legs;

a first film hinge connecting said first leg with said extension arm for relative pivoting movement about a first axis;

a second film hinge connecting said second leg with said second articulating member for relative pivoting movement about a second axis; and a third film hinge connecting said first and second articulating members for relative pivoting movement about a main axis, said main axis being coplanar with said first and second axes only when said articulating members are at an unstable position between the limits of the range of motion, each said elbow being stiffer than any of said film hinges.

2. The structure in accordance with claim 1 in which said first articulating member is a closure base; and said second articulating member is a closure lid.

3. The structure in accordance with claim 2 in which said first elbow is a reduced thickness section of material connecting a portion of said base with said extension arm, said extension arm and base portion each having a thickness adjacent said elbow which is greater than said first elbow thickness.

4. The structure in accordance with claim 2 in which said base includes a panel hinged to a remaining portion of said base, said panel being in a stationary snap-fit engagement with said remaining portion of said base; and said first elbow is unitary with said panel.

5. The structure in accordance with claim 4 in which said panel has a flat side; and said extension arm has a flat side, said arm flat side being substantially perpendicular to said panel flat side when said hinge structure is unstressed, and said arm accommodating movement to a position in which said arm flat side is substantially parallel to said panel flat side.

6. The structure in accordance with claim 2 in which said base has a deck with spaced-apart walls defining the lateral ends of a slot;

said base includes a panel hinged to said lid, said panel being in a stationary snap-fit engagement with said base deck walls; and said first elbow is unitary with said panel.

7. The structure in accordance with claim 1 in which said first and second legs define an included angle having (1) a vertex defined by said second elbow, and (2) an angular measurement of between about 60 degrees and about 100 degrees.

8. The structure in accordance with claim 1 in which said first elbow accommodates rotation of said extension arm about said first elbow through about 90 degrees.

9. The structure in accordance with claim 1 in which first elbow is defined between two concentric circular arc surfaces.

10. The structure in accordance with claim 1 in which said third film hinge axis is spaced from said first elbow.

11. A unitary hinge structure having a range of motion through more than 180° to at least one self-maintained position, said hinge structure comprising:

first and second articulating members connected for relative articulation;

an extension arm extending from said first articulating member to accommodate bending adjacent said first articulating member about 90 degrees;

a spring link, a first film hinge connecting a first end of said spring link with said extension arm for relative pivoting movement about a first axis, and a second film hinge connecting a second end of said spring link with said second articulating member for relative pivoting movement about a second axis; and a third film hinge connecting said first and second articulating members for relative pivoting movement about a main axis, said main axis being coplanar with said first and second axes only when said articulating members are at an unstable position between the limits of the range of motion, each said elbow being stiffer than any of said film hinges.

12. The structure in accordance with claim 11 in which said structure includes a resilient elbow connecting said first extension arm with said first articulating member to accommodate said bending of said first extension arm.

13. The structure in accordance with claim 11 in which said spring link includes a first leg and a second leg.

14. The structure in accordance with claim 13 in which said structure includes a resilient elbow connecting said first and second legs.

15. The structure in accordance with claim 11 in which said first articulating member is a panel adapted to be inserted into a base of a closure, said second articulating member is a lid adapted to cover an opening in a closure base, said panel is molded as a unitary extension of said lid, and said panel includes laterally projecting tabs.

16. A unitary molded closure for a container having an opening, said closure comprising:

a base for mounting to said container around said opening and defining a passage through which the container contents can be discharged:

a lid movable on said base between a closed position occluding said passage and an open position in which said passage is open; and a panel and a hinge connecting said panel to one of said base and lid, said one of said base and lid including a first engaging structure, and said panel including a second engaging structure for effecting a snap-fit engagement with said first engaging structure whereby said closure can be molded as a unitary structure with said panel in a first position, and subsequently said panel can be pivoted about said hinge to a second position with said first and second engaging structures in snap-fit engagement.

17. The structure in accordance with claim 16 in which said panel is hinged to said base.

18. The structure in accordance with claim 16 in which said panel is hinged on one edge to said base and is connected along another edge to said lid.

19. The structure in accordance with claim 16 in which said base includes a receiving aperture defining said first engaging structure; and and said panel includes a tab defining said second engaging structure for being received in said aperture.

20. The closure in accordance with claim 16 in which said panel is located in a peripheral wall of said closure base.

* * * * *